United States Patent [19]

Wild et al.

[11] Patent Number: 4,791,621

[45] Date of Patent: Dec. 13, 1988

[54] SOLAR CELL POWERED CLOCK HAVING A DECORATIVE PENDULUM

[75] Inventors: Gerhard Wild, Denningen; Edgar Haller, Simonswald, both of Fed. Rep. of Germany

[73] Assignee: Junghans Uhren GmbH, Schramberg, Fed. Rep. of Germany

[21] Appl. No.: 19,658

[22] Filed: Feb. 27, 1987

[30] Foreign Application Priority Data

Mar. 8, 1986 [DE] Fed. Rep. of Germany ..... 8606358

[51] Int. Cl.[4] ..... G04C 11/02; G04B 17/02; G04B 1/00

[52] U.S. Cl. ..... 368/47; 368/180; 368/205; 368/223; 368/276

[58] Field of Search ..... 368/223, 134–135, 368/165–166, 179–181, 47, 76, 205

[56] References Cited

U.S. PATENT DOCUMENTS

| | | | |
|---|---|---|---|
| 2,600,081 | 6/1952 | Smyth | 368/179 |
| 2,722,097 | 11/1955 | Lefrand | 368/165 |
| 3,748,846 | 7/1973 | Kikuchi | 368/47 |
| 3,881,310 | 5/1975 | Gerum et al. | 368/47 |
| 3,986,336 | 10/1976 | Heim | 368/180 |
| 4,482,260 | 11/1984 | Fehrenbacher | 368/180 |

FOREIGN PATENT DOCUMENTS

| | | | |
|---|---|---|---|
| 7824116 | 12/1978 | Fed. Rep. of Germany . | |
| 1119215 | 12/1954 | France | 368/205 |

*Primary Examiner*—Vit W. Miska

*Attorney, Agent, or Firm*—Burns, Doane, Swecker & Mathis

[57] ABSTRACT

A solar powered electric clock of the type configured as a traditional 400-day clock with a torsional pendulum includes a housing in which the clockworks, dial face and hands are disposed. The housing is supported over a base by means of vertical columns. Solar cells are mounted in a top surface of the base, along with a storage capacitor. No battery is required. A radio signal receiver mechanism for setting the time in response to external radio signals can be provided and mounted in the housing or base. A pendulum drive mechanism can be mounted in the housing or base. The clockwòrks is driven by a motor which can be mounted in the housing or base.

10 Claims, 2 Drawing Sheets

SOLAR CELL POWERED CLOCK HAVING A DECORATIVE PENDULUM

BACKGROUND OF THE INVENTION

The invention concerns an electric clock driven by solar energy and having a 400-day torsion pendulum. A clock of this generic type is known from German Publication GM- No. 78 24 116.

This invention recognizes that the traditional value of such a 400-day clock is the result of the minimum amount of manual manipulations required for its operation. The torsion pendulum drive is protected under a glass hood, and the clock mechanism exhibits an exceedingly long operating period based on a mechanical energy accumulator. Even after the advent of electronic timekeeping which rendered torsion pendulums obsolete, they were retained for esthetic reasons and maintained in motion by the electrical energy source, occasionally even by the geared or electromechanical drive of the clockworks itself. Despite the advanced electromechanical drive of the clockworks, permanent operation still requires certain manual actuations, e.g., replacement of the electrochemical battery, which is overlaid by the solar cell having a relatively small surface area and being hidden behind the dial face shield.

It is an object of the invention to enhance the usefulness of a timepiece of the afore-mentioned generic type by further reducing the need for the removal of the glass hood of a 400-day clock and possibly even eliminating it in permanent operation.

SUMMARY OF THE INVENTION

The present invention makes use of advanced technology wherein the energy required for the operation of electronic circuits and electromechanical mechanisms is obtained from solar cells exposed to ambient light of the environment, without any intermediate electrochemical storage, and employs that technology to create a 400-day clock which no longer requires servicing in regard to electrical energy. Since solar cells can be decorative in appearance, they are suitable for the conventional design of 400-day clocks in that they may be inserted so as to be visible and may possess a large surface area. By placing the solar cells in the base of such a clock (the capacitive storage element and adaptive circuits, may also be housed in the base), the solar cells (and other elements placed in the base) do not interfere with the design of the clock in the area of its gear mechanism, permitting different types of configurations to be utilized, for example, the configuration of a so-called skeleton clock.

Furthermore, by utilizing a radio receiver designed for the decoding of time information transmitted externally by radio (to insure a correct time display even in the case of the summer-winter time changes), no manual actuation of any kind is needed, so that it is unnecessary to remove the glass hood.

In this manner a decorative pendulum clock, in particular a 400-day torsion pendulum clock is created, the esthetic quality of which is not impaired in comparison with conventional models, while being equipped with the most advanced drive and operating technology in the interest of maintenance-free permanent operation. Further advantages occur in that it is possible to use standardized components (for solar cell operation without batteries) even in the classical configuration of 400-day clocks, which therefore, may be produced or purchased in larger numbers at a reduced cost.

BRIEF DESCRIPTION OF THE DRAWING

The objects and advantages of the invention will become apparent from the following description of preferred embodiments thereof in connection with the accompanying drawings, in which like numerals designate like elements, and in which.

DETAILED DESCRIPTION OF PREFERRED EMBODIMENTS OF THE INVENTION

Figure 1:
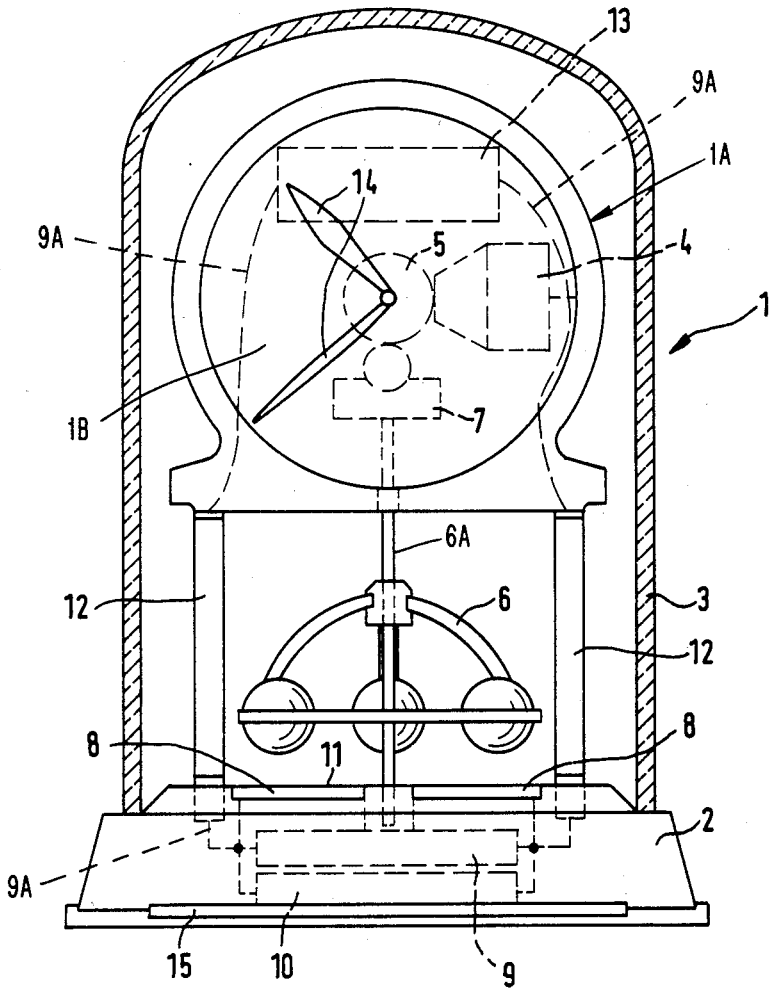
FIG. 1 is a schematic front elevational view of a first embodiment of a clock according to the present invention, with a glass hood thereof shown in vertical section.

The clock 1 shown schematically in a front elevation in the drawing is in the form of a torsion pendulum 400-day clock 1 operated by electromechanical timekeeping. It comprises a clockworks 5 mounted in a housing 1A which is supported on a base 2 by a plurality of columns 12. The clockworks is operated by a step motor 4. A decorative torsion pendulum 6 is provided but performs no timekeeping function. A pendulum drive 7 is electrically or mechanically coupled with the drive of the clockworks 5 by any suitable conventional motion-transmitting mechanism. A dial face 1B is mounted on the housing 1A and hands 14 are provided which are driven by the clockworks 5. A glass hood 3 is preferably provided which rests on the base 2 and covers the rest of the clock.

The electrical energy for driving the clock mechanism 5 and the torsional pendulum 6 is supplied by a power source in the form of at least one, but preferably more, large-surface solar cell 8 together with a high capacity capacitor 9 connected in parallel with the solar cell 8 to serve as a short term source of energy during temporary cell-shaded periods. To improve the efficiency further, there may be provided an adaptive circuit layout 10 comprising a direct current circuit, a motor pulse duration limiting circuit and/or in particular, a response threshold starting circuit, as explained in detail in the inventor's earlier U.S. patent application Ser. No. 06/882,462 filed July 7, 1986 (corresponding to German Application No. P 35 24 290.6 filed July 6, 1985), which is incorporated herein by reference.

The solar cells, capacitor 9, and circuit 10 are located in the base 2. Preferably, the solar cells 8 are installed in or on the upper surface 11 of the base 2 to be exposed to incident light passing through the glass hood 3 and between the columns 12. The capacitor 9 and the adaptive circuit layout 10 are also disposed in the base 2 and are interconnected by short wires to the solar cells 8 and also to the clock driving mechanism 5 and the torsion pendulum drive 7 by means of wires 9A passing through the columns 12.

In this manner, an electromechanically operated 400-day clock 1 without batteries is obtained, which, with the exception of the solar cells 8 which may be set as decorative elements on the base 2, does not appear to be different from conventional electromechanical 400-day clocks 1 with a decorative pendulum 6.

In order to enhance the user friendly aspect of the clock (in addition to the elimination of replaceable batteries), the clock 1 is equipped preferably with a radio signal receiving, decoding and hand-setting device 13, which periodically receives coded time information transmitted by a time information emitter and translates that time information into a correlated angular position of the hands 14 of the clock as described in more detail in U.S. patent application Ser. No. 06/791,555 filed Oct. 25, 1985 and U.S. patent application Ser. No. 06/789,157 (the equivalents being German Application No. P 34 39 638.1 filed Oct. 30, 1984 and German Application GM-No. 84 32 847 filed Nov. 9, 1984), respectively, both disclosures of which are incorporated by reference herein.

Figure 2:
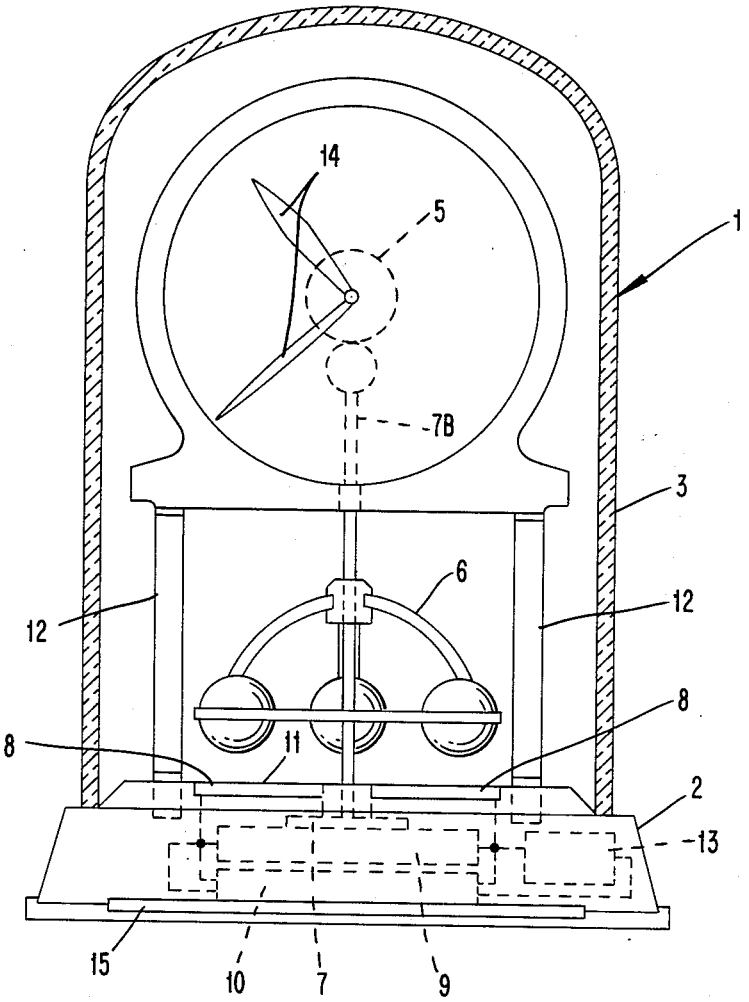
FIG. 2 is a schematic view similar to FIG. 1 of another preferred embodiment of the clock.

The signal receiving device 13 may be located behind the dial plate in the area of the clock mechanism 5 as depicted. If, however, a horizontally oriented ferrite rod antenna 15 is to be installed in the base 2 (formed thus of an electromagnetically non-shielding material) it is more convenient, in the interest of using short electric wires to the receiver inlet of the device 13, to locate the device 13 also in the base 2 (see FIG. 2), in order to avoid the transmission of the high frequency signal by or through the columns 12, thereby reducing the danger of interference signals.

Instead of employing the clock mechanism 5 to drive the pendulum drive 7, the pendulum drive 7 may be of a type which operates independently of the clock mechanism. It is then convenient to locate the pendulum drive 7 in the base 2, i.e., to drive the torsion pendulum from below, as this makes possible a more pleasing, smaller configuration of the clock (see FIG. 2).

Instead of driving the clockworks 5 by means of a step motor 4, a separate drive mechanism, such as the pendulum drive mechanism 7 could be utilized. That mechanism could be connected to drive the pendulum and also could be operably connected to the clockworks 5 by a drive transmission 7B extending through a center shaft 6A of the torsional pendulum 6, in order to drive the clockworks. Hence, the clockworks 5 can be configured as a so-called skeletal mechanism.

Some or all of the mechanism's for operating the gearworks are mounted in the base, enabling different configurations to be utilized, such a the skeletal clockworks mechanism.

It will also be appreciated that in accordance with the present invention, no battery is needed, whereby a torsional pendulum clock is provided which is virtually maintenance-free. Furthermore, by employing a radio-signal receiver for setting the time, it even becomes unnecessary to rest the clock.

Although the present invention has been described in connection with preferred embodiments thereof, it will be appreciated by those skilled in the art that modifications, substitutions, additions and deletions not specifically described, may be made without departing from the spirit and scope of the invention as defined in the appended claims.

What we claim is:

1. A clock comprising:

a housing containing a dial face and hands, and a clockwise mechanism for driving said hands, a support base, vertical column means mounting said housing on said base at a location spaced above said base, a decorative non-timekeeping pendulum depending downwardly from said housing and disposed within an area between said housing and said base, drive means operably connected to said pendulum and said clockworks and including solar cells mounted in said base for generating electrical drive energy, and an electrical storage capacitor disposed in said base and electrically connected to said solar cells, and a radio receiver disposed in said base and operably connected to said drive means for receiving coded radio signals indicative or actual time and for delivering to said drive means a time correction signal in accordance with a difference between actual time and the time indicated by said hands.

2. A clock according to claim 1, wherein said base including an upwardly facing, horizontal top surface, said solar cells disposed in said top surface.

3. A clock according to claim 2, wherein said column means comprises a plurality of spaced-apart columns arranged in an arcuate pattern.

4. A clock according to claim 3, including a transparent glass hood overlying said housing and seated on said base in a manner enclosing said housing, said pendulum, and said solar cells.

5. A clock according to claim 1, wherein said drive means further includes a motor connected to said clockworks and powered by said solar cells.

6. A clock according to claim 1, wherein said pendulum comprises a torsional pendulum which rotates about a vertical shaft, said pendulum drive mechanism including drive transmitting means extending through said shaft and operably connected to said clockworks for driving the latter.

7. A clock according to claim 1 including a radio receiving antenna mounted in said base.

8. A clock according to claim 1, wherein said pendulum comprises a torsional pendulum rotatable about a vertical axis.

9. A clock comprising:

a housing containing a dial face and hands, and a clockworks mechanism for driving said hands, a support base having a horizontally disposed, upwardly facing surface, vertical column means mounting said housing on said base at a location spaced above said surface, a decorative non-timekeeping pendulum depending downwardly from said housing and disposed within a vertical area between said housing and said surface, drive means operably connected to said pendulum and said clockworks and including solar cells carried by said base for generating electrical drive energy, and an electrical storage capacitor disposed in said base and electrically connected to said solar cells, a radio receiver disposed in said base and operably connected to said drive means for receiving coded radio signals indicative of actual time and for emitting a time-correction signal to said drive means in accordance with a difference between actual time and the time indicated by said hands, said solar cells disposed in said horizontal surface such that said pendulum overlies said solar cells, and a transparent glass hood enclosing said housing, said column means, said pendulum, said solar cells, and said hood seated on said base.

10. A clock according to claim 9, wherein said pendulum comprises a torsional pendulum mounted on a vertical shaft, upper and lower ends of said shaft rotatably mounted in said housing and surface, respectively, said solar cells spaced from said shaft, said drive means operably connected to said shaft to rotate said shaft.

* * * * *